US009091490B2

(12) United States Patent
Weinstein

(10) Patent No.: US 9,091,490 B2
(45) Date of Patent: Jul. 28, 2015

(54) OPEN LOOP HEAT PIPE RADIATOR HAVING A FREE-PISTON FOR WIPING CONDENSED WORKING FLUID

(75) Inventor: Leonard M. Weinstein, Newport News, VA (US)

(73) Assignee: THE UNITED STATES OF AMERICA AS REPRESENTED BY THE ADMINISTRATOR OF THE NATIONAL AERONAUTICS AND SPACE ADMINISTRATION, Washington, DC (US)

( * ) Notice: Subject to any disclaimer, the term of this patent is extended or adjusted under 35 U.S.C. 154(b) by 1876 days.

(21) Appl. No.: 11/466,569

(22) Filed: Aug. 23, 2006

(65) Prior Publication Data

US 2008/0047692 A1 Feb. 28, 2008

(51) Int. Cl.
*F28D 15/02* (2006.01)
*F28D 15/06* (2006.01)

(52) U.S. Cl.
CPC ..... *F28D 15/0266* (2013.01); *F28D 15/025* (2013.01); *F28D 15/06* (2013.01)

(58) Field of Classification Search
USPC ..... 165/104.25, 104.31, 104.34, 94; 417/385, 386, 387, 388, 401, 403, 404, 417/535, 536
See application file for complete search history.

(56) References Cited

U.S. PATENT DOCUMENTS 2,347,301 A * 4/1944 Raymond et al. ..... 60/372
3,767,325 A * 10/1973 Schuman ..... 417/207
3,782,859 A * 1/1974 Schuman ..... 417/207
4,072,010 A * 2/1978 Schuman ..... 60/520
4,242,053 A * 12/1980 Mulvenna ..... 417/211
4,406,595 A * 9/1983 Robertson et al. ..... 417/383
4,479,352 A * 10/1984 Yamaoka et al. ..... 60/659
4,716,611 A 1/1988 Barry
4,815,525 A 3/1989 Readman
4,947,825 A 8/1990 Moriarty
4,967,831 A * 11/1990 Leland ..... 165/104.25
5,005,639 A * 4/1991 Leland ..... 165/104.25
5,267,605 A 12/1993 Doty et al.
5,351,747 A 10/1994 Koeppl
5,400,456 A 3/1995 Skibowski
5,537,832 A * 7/1996 Keus ..... 62/544
5,647,734 A * 7/1997 Milleron ..... 417/380
5,983,994 A 11/1999 Tsou
6,014,789 A * 1/2000 Knapp ..... 15/104.063
6,062,828 A * 5/2000 Townsend ..... 417/397
6,170,493 B1 1/2001 Sivacoe
(Continued)

*Primary Examiner* — Frantz Jules
*Assistant Examiner* — Erik Mendoza-Wilkenfel
(74) *Attorney, Agent, or Firm* — Andrea Z. Warmbier; Helen M. Galus

(57) ABSTRACT

An open loop heat pipe radiator comprises a radiator tube and a free-piston. The radiator tube has a first end, a second end, and a tube wall, and the tube wall has an inner surface and an outer surface. The free-piston is enclosed within the radiator tube and is capable of movement within the radiator tube between the first and second ends. The free-piston defines a first space between the free-piston, the first end, and the tube wall, and further defines a second space between the free-piston, the second end, and the tube wall. A gaseous-state working fluid, which was evaporated to remove waste heat, alternately enters the first and second spaces, and the free-piston wipes condensed working fluid from the inner surface of the tube wall as the free-piston alternately moves between the first and second ends. The condensed working fluid is then pumped back to the heat source.

12 Claims, 5 Drawing Sheets

(56) References Cited

U.S. PATENT DOCUMENTS

| | | | | |
|---|---|---|---|---|
| 6,182,615 | B1 * | 2/2001 | Kershaw | 123/19 |
| 6,227,288 | B1 | 5/2001 | Gluck et al. | |
| 6,269,865 | B1 | 8/2001 | Huang | |
| 6,368,080 | B1 * | 4/2002 | Sipin | 417/415 |
| 6,468,057 | B1 * | 10/2002 | Beck | 417/417 |
| 6,591,899 | B1 | 7/2003 | Yee | |
| 6,626,231 | B2 | 9/2003 | Cluzet et al. | |
| 6,854,510 | B2 | 2/2005 | Low et al. | |
| 6,883,588 | B1 | 4/2005 | Low et al. | |
| 6,945,316 | B2 * | 9/2005 | Schildmann et al. | 165/95 |
| 6,952,962 | B2 * | 10/2005 | Hasselbrink et al. | 73/253 |
| 6,991,028 | B2 * | 1/2006 | Comeaux et al. | 165/219 |
| 7,458,418 | B2 * | 12/2008 | Sienel | 165/236 |
| 2002/0185261 | A1 | 12/2002 | Sivacoe | |

* cited by examiner

OPEN LOOP HEAT PIPE RADIATOR HAVING A FREE-PISTON FOR WIPING CONDENSED WORKING FLUID

FIELD OF THE INVENTION

The present invention generally relates to cooling systems and, more particularly, relates to heat pipe radiators.

BACKGROUND OF THE INVENTION

The ability to eliminate waste heat is an important feature of any power generation or power transmitting system, and particularly of space-based power generation or power transmitting systems. Eliminating waste heat is also an important need for human or robotic activity in space. Both nuclear and concentrator types of solar space-based sources of electricity result in the production of several times as much unusable power as is converted to electricity. The only continuous method of eliminating this excess energy in space is by radiation. The high cost of lifting payloads to orbit necessitates thermal management systems with the minimum mass possible.

The rate of radiation heat transfer is proportional to ($T^4_{hot}$–$T^4_{cold}$), where generally $T_{hot}$>>$T_{cold}$. Hence, having the maximum $T_{hot}$ possible for a given system is desirable. However, $T_{hot}$ is determined by the specific power generation process that is used. For example, solar cells are presently limited to operate at a maximum cell temperature below 100° C. If concentrator cells are used, the excess energy is much greater than the amount that can be radiated directly by the cells at these temperatures so an auxiliary radiator is typically needed. Nuclear power systems operate at much higher temperatures, so the materials used in the radiator need to withstand these higher temperatures.

The internal transfer of energy from the waste heat source to the radiators can only be accomplished three ways: (1) conduction across a temperature gradient (through solid, liquid, or gas); (2) single-phase pumped fluid (gas or liquid) moving between different temperatures; or (3) two-phase fluid in a heat pipe using the heat of vaporization and condensation. All three of these methods may be used in space, with each method having advantages and limitations. If the distance from the heat source to the radiator is very small, method (1) may be a desirable method. As working distances increase, (2) and (3) may become more desirable choices. Modest sized cooling systems often use heat pipes since they are reasonably low mass for a given power level, and do not require a large temperature change to transport the energy.

In space heat-pipe systems, capillary action (i.e., wicking), feed gas pressure, or an external pump are typically used to return the condensed liquid (unless the system is in a rotating system using centrifugal force to return the condensed liquid). If the systems are small enough, wick return may be an acceptable method. However, wick return or direct pumping of the condensed liquid by the gas within the condenser limits the liquid return rate and the tied up liquid caused by the limited return rate adds to the total mass (and therefore the cost to lift into space) of these systems. The use of external pump return (open loop) has been previously limited due to the difficulty of isolating and collecting the condensed liquid.

BRIEF SUMMARY OF THE INVENTION

The object of the present invention is to overcome the aforementioned drawbacks of relatively high mass and limitations in size and to provide a heat pipe radiator having a low mass-to-power ratio. The present invention is capable of being manufactured to a large size to provide adequate cooling capacity while maintaining the low mass-to-power ratio desired to provide reduced cost of lifting the radiator into space.

In one embodiment of the invention, a heat pipe radiator comprises a radiator tube and a free-piston. The radiator tube has a first end, a second end, and a tube wall, and the tube wall has an inner surface and an outer surface. The free-piston is enclosed within the radiator tube and is capable of movement within the radiator tube between the first and second ends. The free-piston defines a first space between the free-piston, the first end, and the tube wall, and further defines a second space between the free-piston, the second end, and the tube wall. A gaseous-state working fluid that has been evaporated from a liquid phase at the heat removal source is directed to alternately enter the first and second spaces. The working fluid condenses on the inner surface of the tube wall, such that energy is removed from the working fluid and the energy is radiated by the outer surface of the tube wall. The free-piston wipes condensed working fluid from the inner surface of the tube wall as the free-piston alternately moves between the first and second ends.

The heat pipe radiator may further comprise first and second inlet valves and first and second drain valves. The first and second inlet valves control a flow of the gaseous-state working fluid from an evaporator into the first and second spaces, respectively. The first and second drain valves control a flow of the condensed working fluid out of the first and second spaces, respectively. The heat pipe radiator may further comprise a pump for transporting the condensed working fluid to the evaporator.

The heat pipe radiator may further comprise a plurality of radiator tubes and a plurality of free-pistons. Each radiator tube may have a first end, a second end, and a tube wall, and each tube wall may have an inner surface and an outer surface. Each free-piston may be enclosed within a corresponding radiator tube and capable of movement within the corresponding radiator tube between the first and second ends of the tube. Each free-piston may define a first space between the free-piston, the first end of the corresponding radiator tube, and the tube wall of the corresponding radiator tube, and may define a second space between the free-piston, the second end of the corresponding radiator tube, and the tube wall of the corresponding radiator tube, such that the gaseous-state working fluid alternately enters each of the first and second spaces. The working fluid may condense on the inner surface of each tube wall, such that energy is removed from the working fluid and the energy is radiated by the outer surface of each tube wall. Each free-piston may wipe condensed working fluid from the inner surface of the corresponding radiator tube as each free-piston alternately moves between each of the first and second ends of the radiator tube.

In another embodiment of the invention, a heat pipe radiator comprises radiator means and wiping means. The radiator means have a first end, a second end, and a radiator wall, and the radiator wall has an inner surface and an outer surface. The wiping means are enclosed within the radiator means and capable of movement within the radiator means between the first and second ends. The wiping means define a first space between the wiping means, the first end, and the radiator wall, and further define a second space between the wiping means, the second end, and the radiator wall. A gaseous-state working fluid alternately enters the first and second spaces. The working fluid condenses on the inner surface of the radiator wall, such that energy is removed from the working fluid and the energy is radiated by the outer surface of the radiator wall.

The wiping means wipes condensed working fluid from the inner surface as the wiping means alternately moves between the first and second ends.

The heat pipe radiator may further comprise first and second inflow means and first and second outflow means. The first and second inflow means control a flow of the gaseous-state working fluid from an evaporator into the first and second spaces, respectively. The first and second outflow means control a flow of the condensed working fluid out of the first and second spaces, respectively. The heat pipe radiator may further comprise transport means for transporting the condensed working fluid to the evaporator.

The heat pipe radiator may further comprise a plurality of radiator means and a plurality of wiping means. Each of the plurality of radiator means may have a first end, a second end, and a radiator wall, and each radiator wall may have an inner surface and an outer surface. Each of the plurality of wiping means may be enclosed within a corresponding one of the radiator means and capable of movement within the corresponding radiator means between the first and second ends of the radiator means. Each of the wiping means may define a first space between the wiping means, the first end of the corresponding radiator means, and the radiator wall of the corresponding radiator means, and may further define a second space between the wiping means, the second end of the corresponding radiator means, and the radiator wall of the corresponding radiator means. The gaseous-state working fluid may alternately enter each of the first spaces and each of the second spaces. The working fluid may condense on the inner surface of each radiator wall, such that energy is removed from the working fluid and the energy is radiated by the outer surface of each radiator wall. Each of the wiping means may wipe condensed working fluid from the inner surface of the radiator wall of the corresponding radiator means as the wiping means alternately moves between the first and second ends of the corresponding radiator means.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
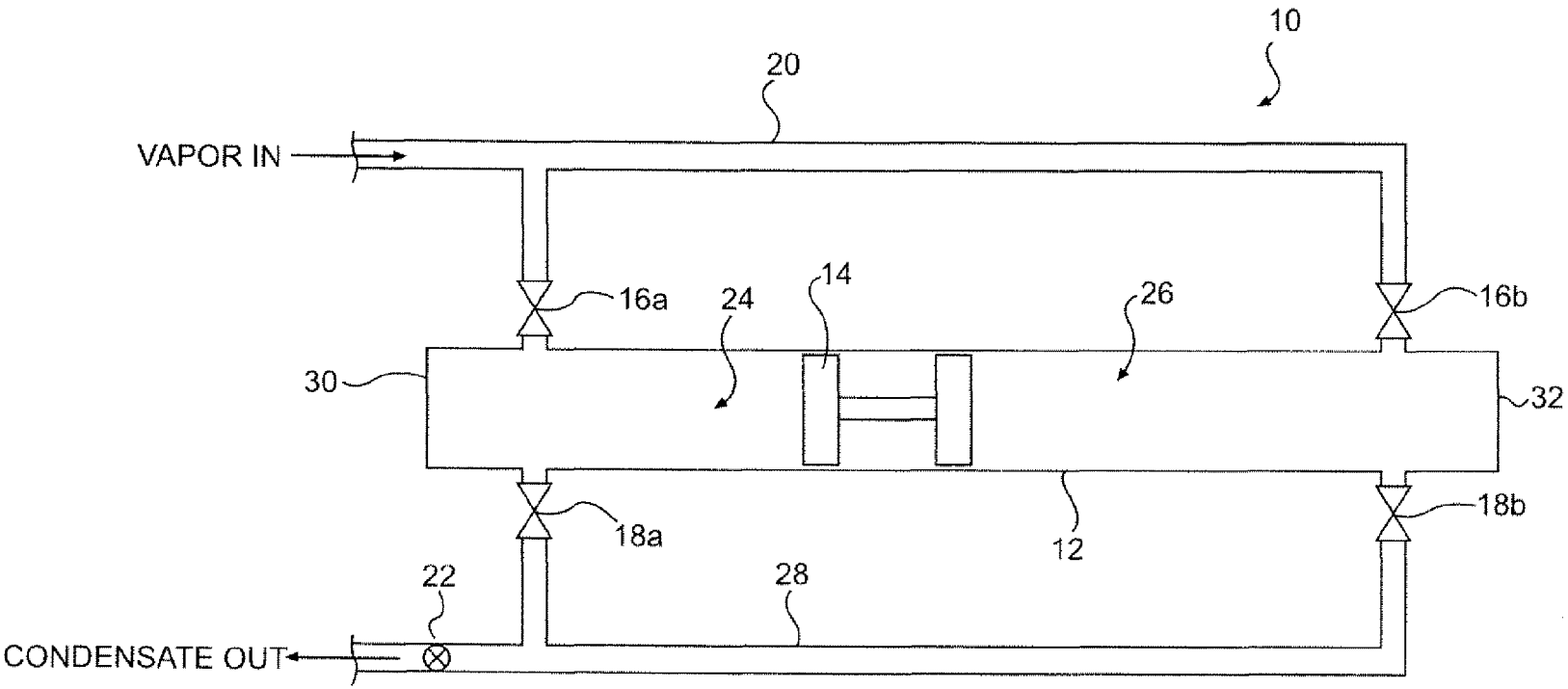
FIG. 1 is a schematic block diagram of a heat pipe radiators, in accordance with one embodiment of the present invention.

Referring now to FIG. 1, a schematic block diagram of a heat pipe radiator is illustrated, in accordance with one embodiment of the present invention. The heat pipe radiator 10 comprises a radiator tube 12, a free-piston 14, a first inlet valve 16*a*, a second inlet valve 16*b*, a first drain valve 18*a*, a second drain valve 18*b*, and a pump 22. The radiator tube 12 typically has a straight cylindrical shape, although other shapes may be possible. The radiator tube is constructed of a strong, lightweight material. The wall of the radiator tube is typically very thin in order to minimize the mass of the tube and maximize the thermal conduction through the wall. As the tube wall is typically very thin, the material used to construct the tube typically need not be highly thermally-conductive. The tube may be constructed out of many different materials, such as aluminum, plastic, steel, and carbon composite. Steel and carbon composite may be desirable materials as the raw materials needed to manufacture steel and carbon composite may be found in space. The temperature of the waste heat to be dissipated will typically affect the material used to construct the tube, as the material must be able to withstand the temperature of the working fluid vapor. The outer surface of the radiator tube is selected or treated to have a high emissivity so that the energy is efficiently radiated.

The free-piston 14 is enclosed within the radiator tube 12 and is capable of a back-and-forth sliding movement within the radiator tube. The shape of the free-piston (as viewed along the longitudinal axis of the radiator tube) conforms to the shape of the inner surface of the radiator tube and the free-piston is sized such that the free-piston fits relatively snugly within the radiator tube, thereby creating a seal between the free-piston and the inner wall of the radiator tube while not significantly hindering the sliding movement of the piston. The seal created between the free-piston and the inner surface of the radiator tube divides the inner space of the radiator tube into two separate spaces-a first space 24 and a second space 26. The first space is formed by the free-piston, the inner surface of the tube and the first end 30 of the tube, while the second space is formed by the free-piston, the inner surface of the tube and the second end 32.

Generally, heat pipe radiators of embodiments of the invention eliminate waste heat from a heat source by evaporating a working liquid at the heat source, thereby removing heat from the heat source. Examples of working fluids include water, ethanol, mercury, glycol, sodium, potassium, and lead. The evaporated (i.e., gaseous-state) working fluid is then alternately directed into the first and second spaces of the radiator tube such that the heat of the gaseous-state working fluid radiates out of the tube, causing the gaseous-state working fluid to condense on the inner surface of the tube. The pressure changes within the tube as the working fluid condenses causes the free-piston to alternately move between the first and second ends thereby wiping condensed working fluid from the inner surface of the tube.

The evaporated working liquid is first directed from the heat source into a manifold line 20. The manifold line 20 is capable of distributing the vapor to one or more radiator tubes via inlet valves. For example, FIG. 1 illustrates a single tube heat pipe radiator in which first inlet valve 16*a* and second inlet valve 16*b* are located between the manifold line and the radiator tube. The first and second inlet valves 16*a*, 16*b* control the flow of the evaporated working fluid from the manifold into the first and second spaces, respectively.

Assuming the first inlet valve 16*a* has been open for a period of time, the first space 24 will contain evaporated working fluid (which may be termed first space vapor) (the first space will also contain some condensed working fluid at this point) and the free-piston would be positioned within the radiator tube such that the free-piston is closer to the second end 32 than to the first end 30. The excess energy contained in the first space vapor will be removed through a process in which the vapor condenses on the inner wall of the tube, the energy released from the vapor by condensation is conducted through the wall, and the outer surface of the wall radiates the energy to space. The first space vapor continues to condense on the continually radiating wall until the buildup of condensate reaches a desired thickness. The desired thickness of the condensate is typically determined by balancing the desirability of minimizing the mass of the working liquid in the system (as a thicker buildup of condensate results in a greater mass of working liquid) and the desirability of minimizing the frequency of cycles (as frequent cycles may result in excessive wear and tear of the system). The desired thickness of the condensate may also be determined at least partly on the length of time required for the piston to move from one end of the radiator tube to the other end. Typically, the thickness of the condensate will not be directly measured (such as through the use of sensors), although such an embodiment may be desirable in certain circumstances and is within the scope of the present invention. Rather, the time to reach the desired thickness will generally be calculated in advance, and thus the elapsed time from the opening of each inlet valve will be measured and used to determine when the desired thickness has been obtained. The time to reach the desired thickness may be calculated based on the power to be dissipated, the heat of vaporization of the working fluid, and the geometry of the radiator tube.

Once the condensate has reached the predetermined thickness on the inner surface within the first space, the vapor in the manifold is then redirected into the second space 26 of the tube. This redirection is accomplished by closing the first inlet valve 16*a* and opening the second inlet valve 16*b*. The vapor in the first space will continue to condense, thereby causing the pressure in the first space to decrease. The vapor now flowing into the second space will also begin to condense, but the pressure in the second space will be maintained at a relatively constant level by the continued inflow of vapor into the second space. Thus, a pressure differential will exist between the first and second spaces, with the pressure within the first space lower than the pressure within the second space. This pressure differential causes the free-piston 14 within the tube to move toward the first end 30. As the free-piston moves, the free-piston wipes the condensation from the inner surface of the radiator tube and forces the condensed working fluid toward the first end 30. After the wiped condensate has accumulated near the first end 30, the first drain valve 18*a* is opened to allow the accumulated condensed fluid to drain from the first space of the radiator tube into drain line 28. After the accumulated condensate has drained from the first space 24, the first drain valve 18*a* is closed. The appropriate time to drain the accumulated condensate may be determined using any of several different methods. For example, the accumulated condensate may be drained just prior to opening the inlet valve into the space from which the accumulated condensate is being drained. Alternatively, the position of the piston within the tube may be determined (e.g., by use of a sensor or by calculating the position based on elapsed time) and the accumulated condensate drained when the piston is determined to be at or near the end of the tube from which the accumulated condensate is being drained.

The vapor being directed into the second space 26 (which may be termed the second space vapor) via the second inlet valve 16*b* will radiate heat out of the second space of the tube causing the vapor to condense on the inner surface of the second space of the tube. The second space vapor continues to condense on the radiating wall until the buildup of condensate reaches a desired thickness. The desired thickness of the second space condensate would typically be the same as the desired thickness of the first space condensate, and would typically be determined the same way. Once the condensate has reached the desired thickness, the vapor in the manifold is then redirected into the first end of the tube. This redirection may be accomplished by closing the second inlet valve 16*b* and opening the first inlet valve 16*a*. The vapor in the second space will continue to condense, thereby causing the pressure in the second space to decrease. The vapor now flowing into the first space will also begin to condense, but the pressure in the first space will be maintained at a relatively constant level by the continued inflow of vapor into the first space. Thus, a pressure differential will exist between the second and first spaces. This pressure differential causes the free-piston 14 within the tube to move toward the second end 32. As the free-piston moves, the free-piston wipes the condensation from the inner surface of the radiator tube and forces the condensed working fluid toward the second end 32. After a predetermined time has elapsed to allow wiped condensate to accumulate near the second end 32, the second drain valve 18*b* is opened to allow the accumulated condensed fluid to drain from the second space of the radiator tube into drain line 28. The appropriate time to drain the accumulated condensate from the second space would typically be determined as discussed above regarding the first space condensate. The drained condensed fluid may be pumped from the drain line back to the evaporator via pump 22.

The vapor from the heat source continues to be alternately directed into the first and second spaces, thereby alternately radiating heat from the first and second spaces, alternately condensing the working fluid in the first and second spaces, and driving the piston back-and-forth within the tube to wipe condensate from the inner surface of the tube. By alternating which end of the tube the vapor is directed into, the radiator operates continuously. Embodiments of the invention permit very lightweight and very long radiators to be used, with rapid return of the working fluid even over very long distances. The low mass and large lengths possible result from the small quantity of working fluid needed and the rapid liquid return rate.

While FIG. 1 illustrates a single tube heat pipe radiator, the heat pipe radiator of embodiments of the invention may comprise a plurality of radiator tubes and a plurality of free-pistons. In such embodiments, separate first and second inlet valves may control the flow of vapor from the manifold to each radiator tube separately, although it may alternatively be desirable to have a single first inlet valve and a single second inlet valve control the flow of vapor from the manifold to multiple radiator tubes. The vapor from the heat source would be alternately directed into the first and second spaces of each tube, thereby alternately radiating heat from the first and second spaces of each tube, alternately condensing the working fluid in the first and second spaces of each tube, and driving each piston back-and-forth within each tube to wipe condensate from the inner surfaces of each tube. The alternate flow of vapor into the first and second spaces of each tube may be synchronously controlled among all the tubes, or may be independently controlled for each tube (independent control would require separate first and second inlet valves for each tube).

Figure 2:
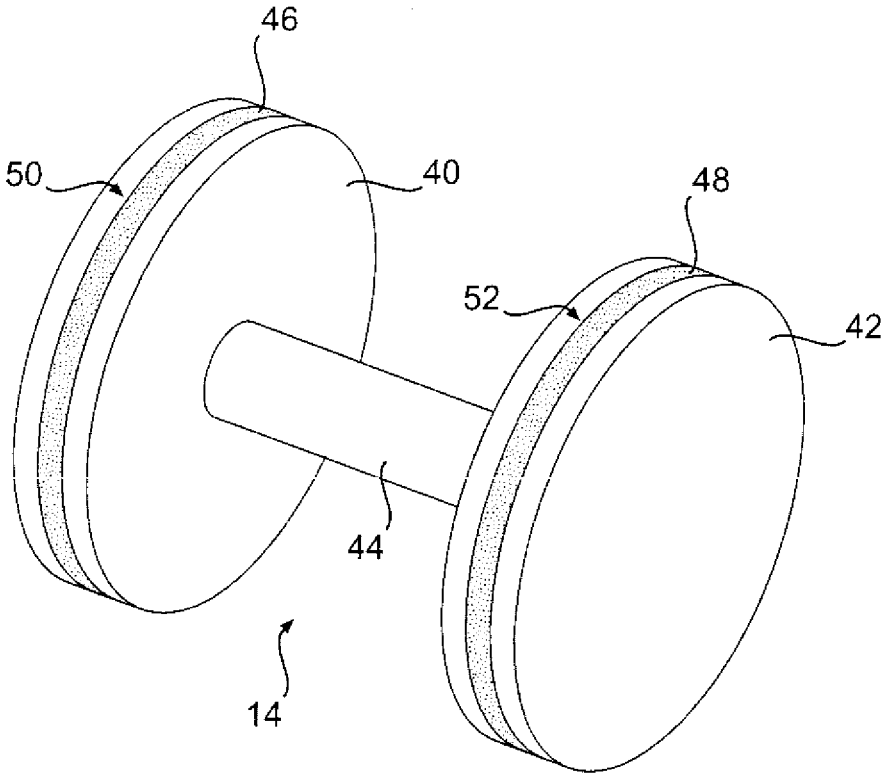
FIG. 2 is a schematic block diagram of a free-piston of a heat pipe radiator, in accordance one embodiment of the present invention.

Referring now to FIG. 2, a schematic block diagram of a free-piston of a heat pipe radiator is illustrated, in accordance one embodiment of the present invention. As discussed above, the shape of the free-piston (as viewed along the longitudinal axis of the radiator tube) conforms to the shape of the inner surface of the radiator tube and the free-piston is sized such that the free-piston fits relatively snugly within the radiator tube, to create a seal between the free-piston and the inner surface of the radiator tube. As the radiator tube is typically cylindrical, the free-piston would typically have a circular cross-section when viewed along the longitudinal axis of the radiator tube. As illustrated in FIG. 2, the free-piston may comprise two end cylinders 40, 42 having a relatively flat shape, joined by a center-cylinder 44 having a relatively elongated shape (i.e., the free-piston is generally "dumbbell" shaped). The end cylinders would have a diameter slightly less than the inner diameter of the radiator tube. The free-piston of FIG. 2 comprises two fluid seals 46, 48 (typically o-rings) seated into grooves formed in the outer surfaces 50, 52 of the end cylinders. The fluid seals 46, 48 contact both the free-piston and the inner surface of the tube to minimize the flow of gaseous or condensed working fluid between the first and second spaces. Although a "dumbbell" shaped free-piston is described herein, other embodiments of the invention may comprise differently shaped free-pistons. For example, the free-piston may comprise a single elongated cylinder having a diameter slightly less than the inner diameter of the radiator tube. Such a single elongated cylinder may have two or more fluid seals seated into grooves formed in the outer surface of the single elongated cylinder. Or, again for example, the free-piston may comprise a single relatively flat shaped cylinder having a diameter slightly less than the inner diameter of the radiator tube, with a single fluid seal seated in a groove formed in its outer surface.

The heat transfer from a heat source to a radiator may involve one or more of the previous mentioned heat transfer processes. The three forms of energy transfer used to carry the energy to radiators (along with the equations used to calculate the energy transfer) are: (1) conduction:

$$Q_{con} = kA\frac{dT}{dx} \quad \text{(Eq. 1)}$$

(in which $Q_{con}$=total conducted power, in watts (W); k=thermal conductivity, in W/[(m)(° K)]; A=cross sectional area, in square meters; T=temperature, in ° K; and x=distance, in meters); (2) single-phase pumped fluid: $Q_{in}=\rho U_0 A C_p(\Delta T)$ (Eq. 2) (in which $Q_{in}$=total available power from fluid flowing into open end of tube, in watts; ρ=density, in kilograms (kg) per cubic meter; $U_0$=pipe inlet mean velocity, in meters (m) per second; and $C_p$=specific heat, in J/[(kg)(° K)]; and (3) two-phase heat-pipe: $Q_{vap}=\rho U_0 A(\Delta H_{Vap})$ (Eq. 3) (in which $Q_{vap}$=total power used to vaporize liquid to gas or released by condensation back, in watts; and $\Delta H_{vap}$=heat of vaporization of the working fluid, in joules (J) per kilogram).

The conductor generally has to have a large temperature gradient and very high conductivity in order to transport a large amount of energy. Even good conductors such as metals are greatly limited in the energy transport available over even modest distances. Single-phase fluid flow requires a significant temperature drop at the radiator in order to transport much energy. Using gases for transport limits the energy transported due to the far lower density of gases compared to liquids. However, the level of power transmitted by pumping either fluid does not have the distance limitation present with conduction. The use of heat of vaporization and re-condensation can transport a high level of power with a very small temperature drop. The working fluid selected for this approach depends on the desired temperature needed. The power ratios for equal transported masses of working fluids, using the heat of vaporization compared to pumped single phase flow heat capacity, can be far more favorable for the two-phase fluid, as illustrated by the following equation: $Q_{vap}/Q_{in}=(\Delta H_{vap}/(C_p\Delta T)$ (Eq. 4). In general, the use of a heat pipe moves energy with a minimum working fluid mass if the required power removal rates can be practically achieved.

Figure 3:
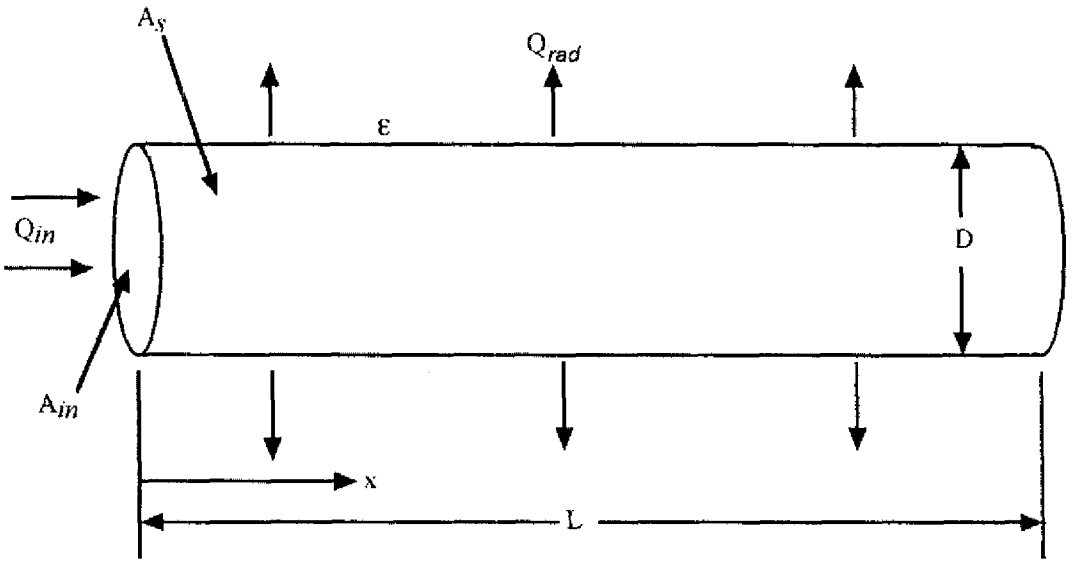
FIG. 3 illustrates the basic fluid flow and power balance of a heat pipe radiator.

Referring now to FIG. 3, the basic fluid flow and power balance of a heat pipe radiator are illustrated. Any space radiator would generally have two imposed requirements: (1) level of power radiated; and (2) operating temperature (due to the heat source and material constraints). The power radiated is transported by the working fluid, such that $Q_{rad}=Q_{in}$ (in which $Q_{rad}$=total power radiating from the wall of the radiator tube, in watts). The operating temperature and choice of working fluid and radiator materials are selected based on the desired physical setup. This determines the choice of values of ρ, $T_{hot}$ (average fluid and wall inner temperature, in ° K), $\Delta H_{vap}$, and ϵ (emissivity). For a radiator pipe having an entrance area $A_{in}$, and a pipe surface area $A_s$ the following equations apply:

$$A_{in}=\pi D^2/4$$

$$A_s=\pi DL$$

$$(dm/dt)=\rho U_0 A_{in}=\pi\rho U_0 D^2/4$$

$$Q_{in}=(\Delta H_{vap})(dm/dt)=(\Delta H_{vap})(\pi\rho U_0 D^2/4$$

$$Q_{rad}=\epsilon\sigma(T^4_{hot}-T^4_{cold})\pi DL$$

(in which D=pipe diameter, in meters; L=pipe length, in meters; m=mass flow, in kilograms per second; σ=Stephan-Boltzmann constant, in W/[(m²)(° K⁴)]; and $T_{cold}$=average radiation sink temperature (i.e., temperature of external surroundings), in ° K).

Using the above equations and solving for the input mean velocity to the radiator tube results in: $U_0=[4\epsilon\sigma T^4_{hot}-T^4_{cold})/\rho(\Delta H_{vap})](L/D)$ (Eq. 5). This relates the mean input velocity of the tube to the required length-to-diameter ratio. Alternately, it is possible to solve for the required tube diameter in terms of the imposed requirements described above. From Eq. 5 and $Q_{in}$ above, the following equation applies: $Q_{in}=Q_{rad}=(\Delta H_{vap})(\pi\rho U_0 D^2/4)$. This in turns enables the tube diameter to be calculated using the equation: $D=[4Q_{rad}/\pi\rho U_0(\Delta H_{vap}]^{0.5}$ (Eq. 6). It is also possible to determine the required length of the radiator tube from the tube diameter. From the equation solving for $Q_{rad}$ above, the required length may be calculated using the equation: $L=(Q_{rad}/\epsilon\sigma(T^4_{hot}-T^4_{cold})\pi D)$ (Eq. 7). Equations (5), (6), and (7) enable parameters such as input velocity, length, diameter, or length-to-diameter ratio for a given system to be related.

Since the surface area of the radiator tube is proportional to the tube length, and since the radiation temperature is nearly constant for the condensation type of heat transfer, the mass flux would typically decrease as a linear function of location along the length of the tube. For the following analysis, the wall skin friction-induced pressure drop compared to the total pressure is neglected, and this results in a linear drop in mean velocity along the length of the tube. Referring again to FIG. 3, $U_x=U_0[1-x/L]=(U_0/L)[L-x]$ (in which $U_x$ is the pipe mean velocity at distance x along the length of the pipe). As $U_x dt=dx$ (for vapor flow in the tube), it is possible to define a reference time using the equation: $t_0=L/U_0$. Then $dt=dx/U_x=t_0\lfloor dx/(l-x)\rfloor$. Integrating 0 to x gives: $t(x)=t_0 \ln\{[1-(x/L)]^{-1}\}$ (Eq. 8).

Figure 4:
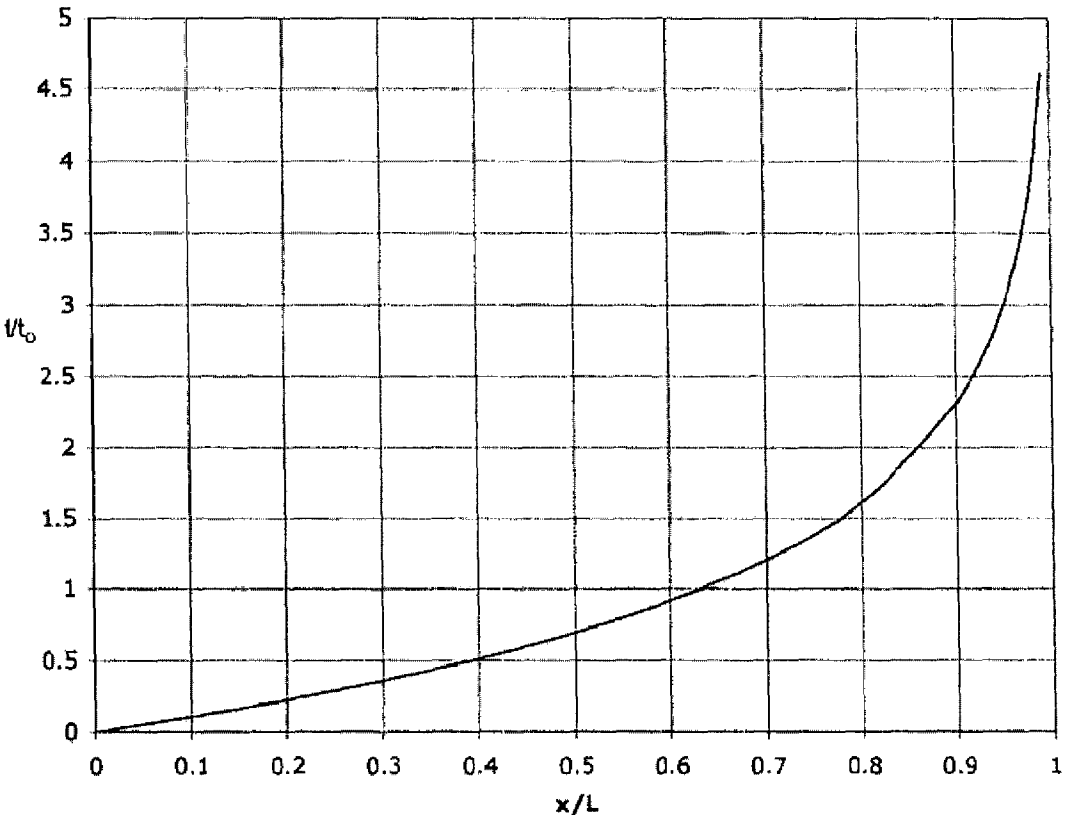
FIG. 4 illustrates the relative time required for movement of an ideal piston over a desired distance within a radiator tube.

If the vapor entering the tube had uniform velocity, equation (8) would give the length of time needed for the vapor to move from x=0 to a given location along the length of the radiator tube. This length of time is also the minimum time for the piston to move to that distance due to condensation of trapped vapor. However, the time for the piston to move would typically be longer than the calculated minimum, since a finite pressure would need to be generated to move the piston. A plot of $t(x)/t_0$ is illustrated in FIG. 4. The condensed fluid on the inner wall of the tube would be allowed to condense for a predetermined time, and then the condensed fluid would be pushed to the end of the tube for recovery. As an example, if the volume of the condensed fluid were 1% of the tube volume, this would result in a minimum time for the free-piston movement needed to push the liquid to the end to be about 4.6 times $L/U_0$. A plot of the relative time for the ideal piston to move to a given location is illustrated in FIG. 4.

Figure 5:
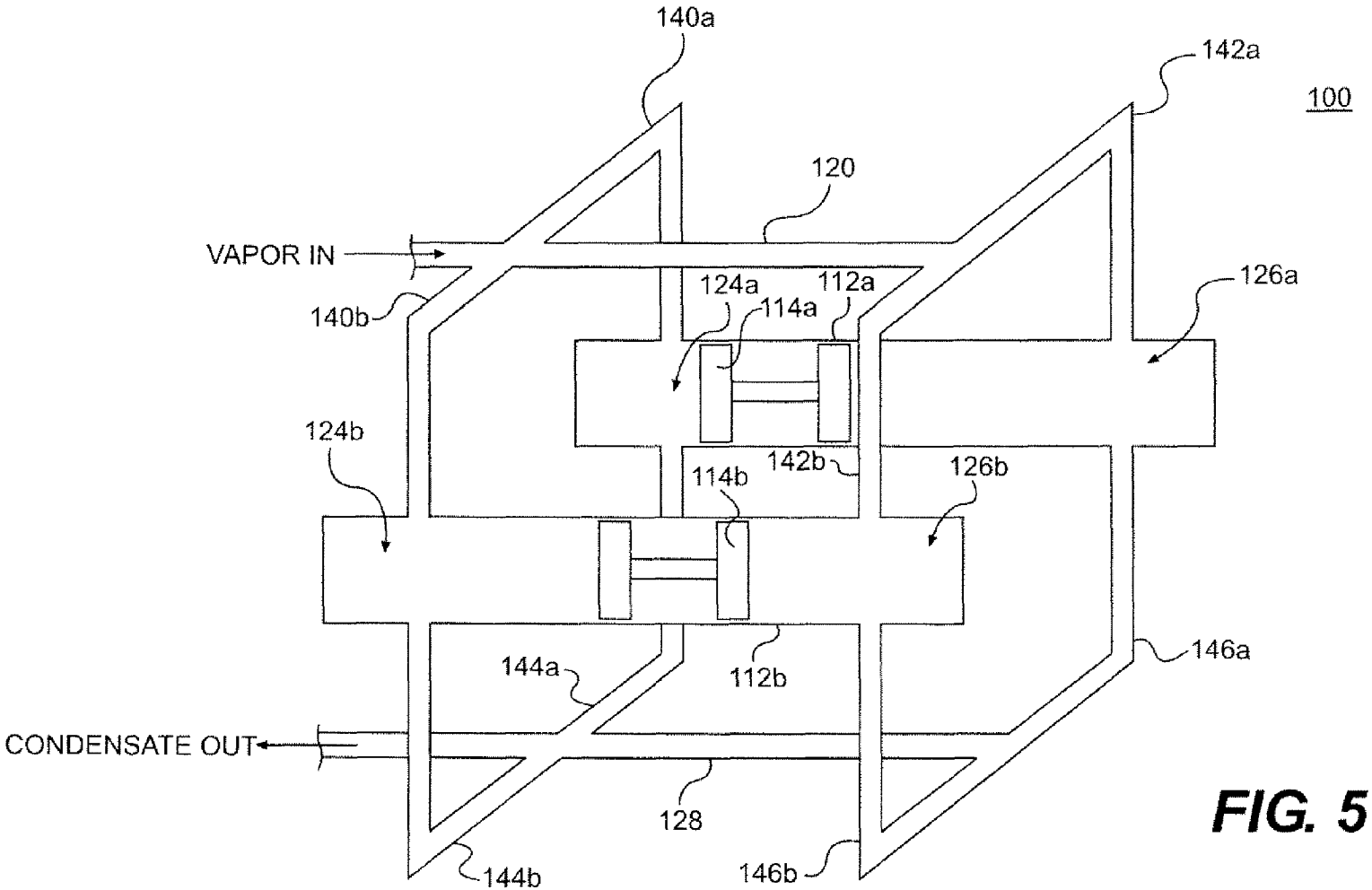
FIG. 5 is a schematic block diagram of a heat pipe radiator, in accordance with an alternative embodiment of the present invention

Referring now to FIG. 5, a schematic block diagram of a heat pipe radiator is illustrated, in accordance with an alternative embodiment of the present invention. The heat pipe radiator 100 of FIG. 5 comprises two radiator tubes 112*a*, 112*b* and two corresponding free-pistons 114*a*, 114*b*. In the embodiment of FIG. 5, separate first and second inlet valves (not illustrated) would typically control the flow of vapor from the manifold line 120 to each radiator tube separately. The vapor from the heat source is alternately directed into the first spaces 124*a*, 124*b* and second spaces 126*a*, 126*b* of each tube, thereby alternately radiating heat from the first and second spaces of each tube, alternately condensing the working fluid in the first and second spaces of each tube, and driving each piston back-and-forth within each tube to wipe condensate from the inner surfaces of each tube. The alternate flow of vapor into the first and second spaces of each tube may be synchronously controlled, or may be independently controlled for each tube (independent control would require separate first and second inlet valves for each tube).

The evaporated working liquid is first directed from the heat source into a manifold line 120. The manifold line 120 is capable of distributing the vapor to one or more radiator tubes via distribution lines 140*a*, 140*b*, 142*a*, 142*b*. The inlet valves would typically be located within these distribution lines to control the flow of the evaporated working fluid from the manifold into the first and second spaces of the two radiator tubes.

Other than needing to control the flow of the evaporated working liquid to two different radiator tubes, the operation of heat pipe radiator 100 is identical to that of heat pipe radiator 10 of FIG. 1.

The accumulated condensed fluid is drained from the two radiator tubes into drain line 128 via drain feed lines 144*a*, 144*b*, 146*a*, 146*b*. Separate first and second drain valves (not illustrated) would typically control the flow of the accumulated condensed fluid from each radiator tube into the drain line.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A heat pipe radiator to dissipate waste heat comprising:

a radiator tube having a first end, a second end, and a tube wall, the tube wall having an inner surface and an outer surface, wherein the tube wall maximizes thermal conduction to dissipate waste heat;

a pressure driven free-piston enclosed within the radiator tube and capable of movement within the radiator tube between the first and second ends, wherein the free-piston comprises a fluid seal, the free-piston defining a first space between the free-piston, the first end, and the tube wall, and further defining a second space between the free-piston, the second end, and the tube wall, wherein the fluid seal is in contact with the inner surface of the tube wall and the free-piston to minimize the flow of a working fluid between the first space and the second space;

wherein a gaseous-state of a two-phase working fluid alternately enters the first and second spaces and condenses on the inner surface of the tube wall, such that energy is removed from the working fluid and the energy is radiated by the outer surface of the tube wall, and wherein the free-piston wipes condensed working fluid from the inner surface as the free-piston alternately moves between the first and second ends.

2. The heat pipe radiator of claim 1, further comprising:

first and second inlet valves to control a flow of the gaseous-state working fluid from an evaporator into the first and second spaces, respectively; and first and second drain valves to control a flow of the condensed working fluid out of the first and second spaces, wherein the first and second drain valves are adapted to be opened to drain after the condensed working fluid accumulates in the first space or second space.

3. The heat pipe radiator of claim 2, further comprising:

a pump for transporting the condensed working fluid to the evaporator.

4. The heat pipe radiator of claim 1, further comprising:

a plurality of radiator tubes, each having a first end, a second end, and a tube wall, each tube wall having an inner surface and an outer surface;

a plurality of free-pistons, each free-piston enclosed within a corresponding one of the plurality of radiator tubes and capable of movement within the corresponding radiator tube between the first and second ends of the corresponding radiator tube, each free-piston defining a first space between the free-piston, the first end of the corresponding radiator tube, and the tube wall of the corresponding radiator tube, and further defining a second space between the free-piston, the second end of the corresponding radiator tube, and the tube wall of the corresponding radiator tube;

wherein the gaseous-state working fluid alternately enters each of the first spaces and each of the second spaces and condenses on the inner surface of each tube wall, such that energy is removed from the working fluid and the energy is radiated by the outer surface of each tube wall, and wherein each free-piston wipes condensed working fluid from the inner surface of the corresponding radiator tube as each free-piston alternately moves between each of the first and second ends of the corresponding radiator tube.

5. A heat pipe radiator to dissipate waste heat comprising:

radiator means having a first end, a second end, and a radiator wall, the radiator wall having an inner surface and an outer surface, wherein the tube wall maximizes thermal conduction to dissipate waste heat; and pressure driven wiping means enclosed within the radiator means and capable of movement within the radiator means between the first and second ends, wherein the wiping means comprises a fluid seal, the wiping means defining a first space between the wiping means, the first end, and the radiator wall and further defining a second space between the wiping means, the second end, and the radiator wall, wherein the fluid seal is in contact with the inner surface of the tube wall and the wiping means to minimize the flow of a working fluid between the first space and the second space;

wherein a gaseous-state working fluid alternately enters the first and second spaces and condenses on the inner surface of the radiator wall, such that energy is removed from the working fluid and the energy is radiated by the outer surface of the radiator wall, and wherein the wiping means wipes condensed working fluid from the inner surface as the wiping means alternately moves between the first and second ends.

6. The heat pipe radiator of claim 5, further comprising:

first and second inflow means for controlling a flow of the gaseous-state working fluid from an evaporator into the first and second spaces, respectively; and first and second outflow means for controlling a flow of the condensed working fluid out of the first and second spaces, respectively.

7. The heat pipe radiator of claim 6, further comprising:

transport means for transporting the condensed working fluid to the evaporator.

8. The heat pipe radiator of claim 5, further comprising:

a plurality of radiator means, each having a first end, a second end, and a radiator wall, each radiator wail having an inner surface and an outer surface; and a plurality of wiping means, each wiping means enclosed within a corresponding one of the plurality of radiator means and capable of movement within the corresponding radiator means between the first and second ends of the corresponding radiator means, each wiping means defining a first space between the wiping means, the first end of the corresponding radiator means, and the radiator wall of the corresponding radiator means, and further defining a second space between the wiping means, the second end of the corresponding radiator means, and the radiator wall of the corresponding radiator means;

wherein the gaseous-state working fluid alternately enters each of the first spaces and each of the second spaces and condenses on the inner surface of each radiator wall, such that energy is removed from the working fluid and the energy is radiated by the outer surface of each radiator wall, and wherein each wiping means wipes condensed working fluid from the inner surface of the corresponding radiator means as each wiping means alternately moves between each of the first and second ends of the corresponding radiator means.

9. The heat pipe radiator of claim 1, wherein pressure changes within the radiator tube as the working fluid condenses cause the free-piston to alternately move between the first and second ends.

10. The heat pipe radiator of claim 5, wherein pressure changes within the radiator means as the working fluid condenses cause the wiping means to alternately move between the first and second ends.

11. The heat pipe radiator of claim 1, the radiator tube comprising a material consisting essentially of aluminum, plastic, steel, or carbon composites.

12. The heat pipe radiator of claim 1, wherein the free-piston comprises a dumbbell shape.

* * * * *